US011081079B2

(12) United States Patent
Wen et al.

(10) Patent No.: US 11,081,079 B2
(45) Date of Patent: Aug. 3, 2021

(54) DISPLAY DEVICE AND DRIVING CIRCUIT OF DISPLAY DEVICE

(71) Applicant: AU OPTRONICS CORPORATION, Hsin-Chu (TW)

(72) Inventors: Chun-Kuei Wen, Hsin-Chu (TW); Chun-Yu Chen, Hsin-Chu (TW); Hung-Min Shih, Hsin-Chu (TW); Jie-Chuan Huang, Hsin-Chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 0 days.

(21) Appl. No.: 16/395,306

(22) Filed: Apr. 26, 2019

(65) Prior Publication Data

US 2019/0333467 A1 Oct. 31, 2019

(30) Foreign Application Priority Data

Apr. 30, 2018 (TW) ..... 107114712

(51) Int. Cl.
*G09G 3/36* (2006.01)

(52) U.S. Cl.
CPC ..... *G09G 3/3696* (2013.01); *G09G 3/3685* (2013.01); *G09G 2310/0243* (2013.01); *G09G 2310/0289* (2013.01); *G09G 2310/0297* (2013.01)

(58) Field of Classification Search
CPC ..... G09G 3/3696; G09G 3/3685; G09G 2310/0243; G09G 2310/0289; G09G 2310/0297; G09G 3/3688; G09G 2310/08; G09G 2370/08; G09G 2310/027; G09G 3/20
See application file for complete search history.

(56) References Cited

U.S. PATENT DOCUMENTS

2002/0105494 A1* 8/2002 Lin ..... G09G 3/3696 345/101
2015/0161927 A1* 6/2015 Hekstra ..... G09G 3/3614 345/209
2016/0260375 A1* 9/2016 Ruan ..... G09G 3/32
2018/0096666 A1* 4/2018 Chung ..... G09G 3/3696

OTHER PUBLICATIONS

Su Hyeong Park et al., "Liquid Crystal Display and Driving Method Thereof", U.S. Appl. No. 14/523,590, filed Oct. 24, 2014.

* cited by examiner

*Primary Examiner* — Andrew Sasinowski
(74) *Attorney, Agent, or Firm* — WPAT, PC

(57) ABSTRACT

A display device includes an output circuit, a multiplexer, and a controller. The output circuit is configured to output a data voltage to an output pin. The multiplexer is configured to sequentially output the data voltage to different data lines according to a first multiplexing signal and a second multiplexing signal. The controller is configured to generate a control signal according to a variation of the data voltage to make the output pin output a default voltage level different from the data voltage corresponding to the data voltage.

18 Claims, 11 Drawing Sheets

DISPLAY DEVICE AND DRIVING CIRCUIT OF DISPLAY DEVICE

RELATED APPLICATIONS

This application claims priority to Taiwan Application Serial Number 107114712, filed Apr. 30, 2018, which is herein incorporated by reference.

BACKGROUND

Technical Field

This disclosure relates to an electronic device and a circuit. In particular, this disclosure relates to a display device and a driving circuit.

Related Art

With the development of technologies, display devices have been widely used in people's lives.

A typical display device may include a gate driver, a source driver, and a pixel circuit. The gate driver is configured to supply a gate signal to the pixel circuit to turn on a switch of the pixel circuit. The source driver is configured to supply a data voltage to the pixel circuit of which the switch is on to make the pixel circuit display corresponding to the data voltage.

SUMMARY

An implementation aspect of this disclosure relates to a display device. According to an embodiment of this disclosure, the display device includes an output circuit, a multiplexer, and a controller. The output circuit is configured to output a data voltage to an output pin. The multiplexer is configured to sequentially output the data voltage to different data lines according to a first multiplexing signal and a second multiplexing signal. The controller is configured to generate a control signal corresponding to a variation of the data voltage to make the output pin output a default voltage level different from the data voltage corresponding to the data voltage.

Another implementation aspect of this disclosure relates to a display device. According to an embodiment of this disclosure, the display device includes an output circuit, a multiplexer, a controller, and a switching circuit. The output circuit is configured to output a data voltage to an output pin. The multiplexer is configured to sequentially output the data voltage to different data lines according to at least one multiplexing signal. The controller is configured to generate a control signal corresponding to a variation of the data voltage. The switching circuit is electrically connected between the output pin and the multiplexer, and configured to selectively make the output pin output one of a default voltage level and the data voltage corresponding to the control signal and the data voltage, where the default voltage level is different from the data voltage.

Another implementation aspect of this disclosure relates to a driving circuit of a display device. According to an embodiment of this disclosure, the driving circuit includes an output circuit, a multiplexer, and a switching circuit. The output circuit is configured to output a data voltage to an output pin. The multiplexer is configured to perform a switching operation to sequentially output the data voltage to different data lines. The switching circuit is electrically connected between the output pin and the multiplexer, and configured to selectively make the output pin output one of a default voltage level and the data voltage corresponding to the switching operation of the multiplexer and the variation of the data voltage, where the default voltage level is different from the data voltage.

By applying one embodiment described above, the noise in touch sensing can be reduced to improve the quality of a display device.

DETAILED DESCRIPTION

Figure 1:
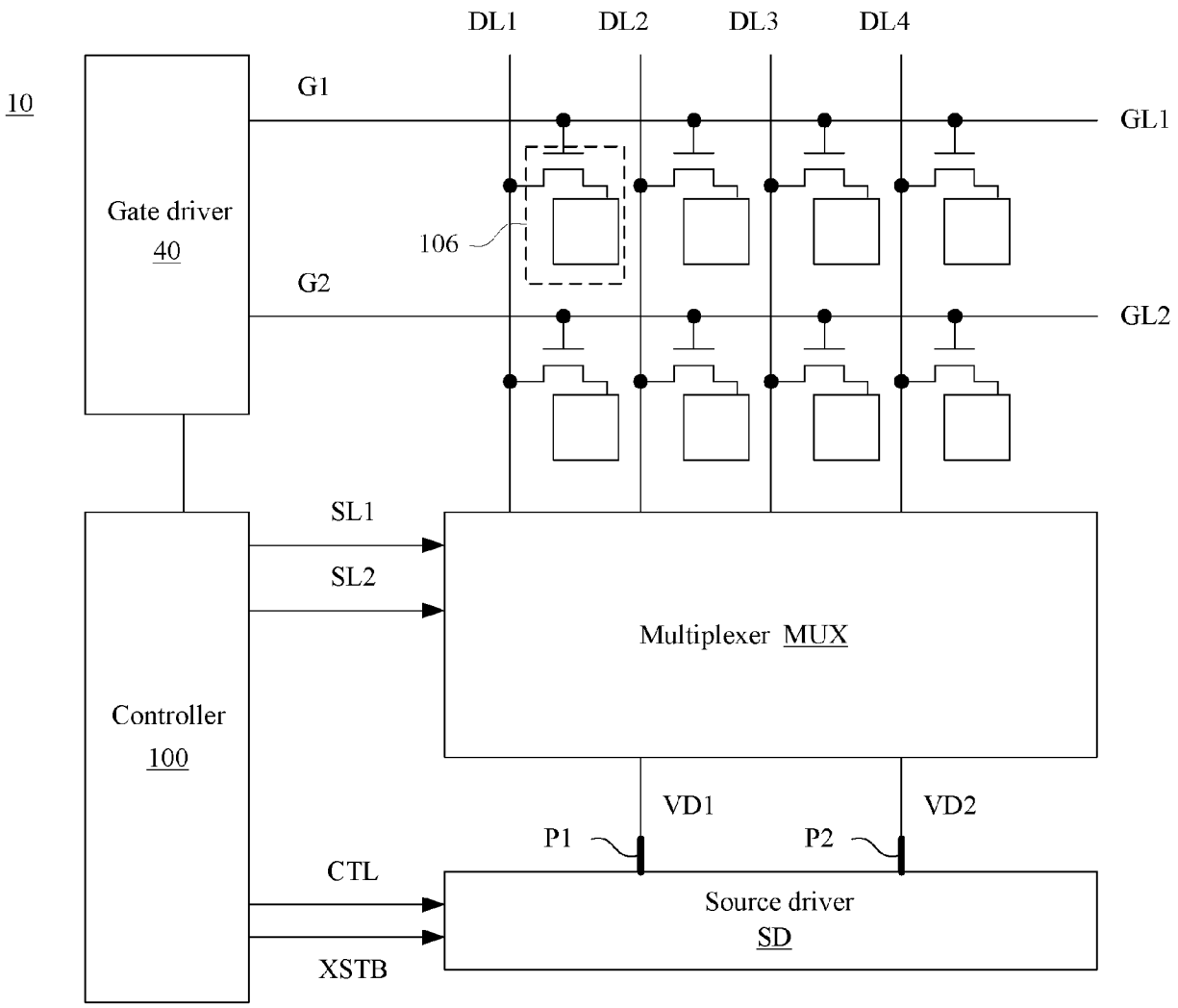
FIG. 1 is a schematic diagram of a display device according to an embodiment of this disclosure.

Reference will now be made in detail to the present embodiments of the invention, examples of which are illustrated in the accompanying drawings. Wherever possible, the same reference numbers are used in the drawings and the description to refer to the same or like parts.

It will be understood that, in the description herein and throughout the claims that follow, although the terms "first," "second," etc. may be used to describe various elements, these elements should not be limited by these terms. These terms are only used to distinguish one element from another. For example, a first element could be termed a second element, and, similarly, a second element could be termed a first element, without departing from the scope of the embodiments.

It will be understood that, in the description herein and throughout the claims that follow, when an element is referred to as being "electrically connected" or "electrically coupled" to another element, it can be directly connected or coupled to the other element or intervening elements may be present. In contrast, when an element is referred to as being "directly connected" or "directly coupled" to another element, there are no intervening elements present. Moreover, "electrically connect" or "connect" can further refer to the interoperation or interaction between two or more elements.

It will be understood that, in the description herein and throughout the claims that follow, the terms "comprise" or "comprising," "include" or "including," "have" or "having," "contain" or "containing" and the like used herein are to be understood to be open-ended, i.e., to mean including but not limited to.

It will be understood that, in the description herein and throughout the claims that follow, the phrase "and/or" includes any and all combinations of one or more of the associated listed items.

It will be understood that, in the description herein and throughout the claims that follow, the meaning of "a," "an," and "the" includes reference to the plural unless the context clearly dictates otherwise.

It will be understood that, in the description herein and throughout the claims that follow, unless otherwise defined, all terms (including technical and scientific terms) have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any element in a claim that does not explicitly state "means for" performing a specified function, or "step for" performing a specific function, is not to be interpreted as a "means" or "step" clause as specified in 35 U.S.C. § 112(f). In particular, the use of "step of" in the claims herein is not intended to invoke the provisions of 35 U.S.C. § 112(f).

FIG. 1 is a schematic diagram of a display device 10 drawn according to an embodiment of this disclosure. In this embodiment, the display device 10 includes a controller 100, pixel circuits 106, a source driver SD, a gate driver 40, data lines DL1-DL4, gate lines GL1 and GL2, and a multiplexer MUX. In this embodiment, the pixel circuits 106 are arranged in a matrix. In one embodiment, the controller 100 is electrically connected to the source driver SD, the gate driver 40, and the multiplexer MUX. In one embodiment, the multiplexer MUX is electrically connected between the data lines DL1-DL4 and the output pins P1 and P2 of the source driver SD.

It should be noted that in this embodiment, although the display device 10 of 2*4 size is taken as an example, the number of elements and lines in the display device 10 is not limited thereto, and other numbers of the above elements and lines are also within the scope of this disclosure.

In one embodiment, the gate driver 40 is configured to supply gate signals G1 and G2 to the pixel circuits 106 through the gate lines GL1 and GL2 row by row to turn on switches of the pixel circuits 106 in the pixel circuits 106 row by row.

In one embodiment, the source driver SD is configured to supply data voltages VD1 and VD2 to the multiplexer MUX respectively through the output pins P1 and P2 according to a trigger signal XSTB. In addition, the source driver SD is also configured to output a default voltage level different from the data voltages VD1 and VD2 through the output pins P1 and P2 according to a control signal CTL. In one embodiment, the default voltage level is a fixed level, but this disclosure is not limited thereto.

In one embodiment, the multiplexer MUX is configured to perform a switching operation according to multiplexing signals SL1-SL2 to selectively connect the output pin P1 to a corresponding one of the data lines DL1-DL4, and connect the output pin P2 to another corresponding one of the data lines DL1-DL4 to supply the data voltages VD1 and VD2 to the corresponding ones of the pixel circuits 106. In one embodiment, the multiplexing signals SL1-SL2 are substantially opposite in phase to each other, but this disclosure is not limited thereto.

For example, in a first period, the multiplexer MUX can respectively connect the output pins P1 and P2 to two of the data lines DL1-DL4 according to the multiplexing signals SL1-SL2 to make the multiplexer MUX respectively output the data voltages VD1 and VD2 to the two of the data lines DL1-DL4.

In a second period, the multiplexer MUX can respectively connect the output pins P1 and P2 to the other two of the data lines DL1-DL4 according to the multiplexing signals SL1-SL2 to make the multiplexer MUX respectively output the data voltages VD1 and VD2 to the other two of the data lines DL1-DL4.

In one embodiment, the multiplexer MUX may be a combination of a plurality of one-to-two multiplexers, but this disclosure is not limited thereto. Moreover, in some embodiments, the display device 10 can also be implemented by using other forms (e.g., one-to-three, one-to-four, etc.) of multiplexers.

In one embodiment, the controller 100 is configured to generate the control signal CTL, the trigger signal XSTB, and the multiplexing signals SL1-SL2 mentioned above. The controller 100 uses the control signal CTL to make the source driver SD output a default voltage level different from the data voltages VD1 and VD2 through the output pins P1 and P2 in a specific period, thereby reducing the noise in touch sensing in the display device 10.

In one embodiment, the controller 100 can receive a video signal from a host and generate the control signal CTL, the trigger signal XSTB, and the multiplexing signals SL1-SL2 mentioned above according to the video signal. In one embodiment, the controller 100 can generate grayscale data DATA according to the aforementioned video signal to make the source driver SD generate the aforementioned data voltages VD1 and VD2 according to the grayscale data DATA. In one embodiment, the controller 100 generates the aforementioned control signal CTL corresponding to the multiplexing signals SL1-SL2 and the grayscale data DATA.

In one embodiment, the source driver SD can generate the data voltages VD1 and VD2 according to grayscale values in the grayscale data DATA. For example, in the positive polarity state of the data voltage VD1, the source driver SD can generate the data voltages VD1 and VD2 of 0V to +5V according to the grayscale values of 0 to 255. In the negative polarity state of the data voltage VD1, the source driver SD can generate the data voltages VD1 and VD2 of 0V to −5V according to the grayscale values of 0 to 255. It should be noted that the voltage level here is only an example, and this disclosure is not limited thereto.

In one embodiment, the controller 100 can be implemented by using a timing controller, but this disclosure is not limited thereto. In one embodiment, functions of the controller 100 may be implemented by a programmable logic device (PLD) and/or other hardware circuits therein, but this disclosure is not limited thereto. In addition, although separately depicted in FIG. 1, in other embodiments, the controller 100 can be integrated into the source driver SD. In other embodiments, some of the functions of the controller 100 may also be integrated into the source driver SD.

The specific details of an operation example of this disclosure will be described below with reference to FIG. 1 FIG. 2. However, this disclosure is not limited to the following operation example. It should be noted that although the following describes only the data voltage VD1 as an example, the data voltage VD2 may have similar related operations.

Figure 2:
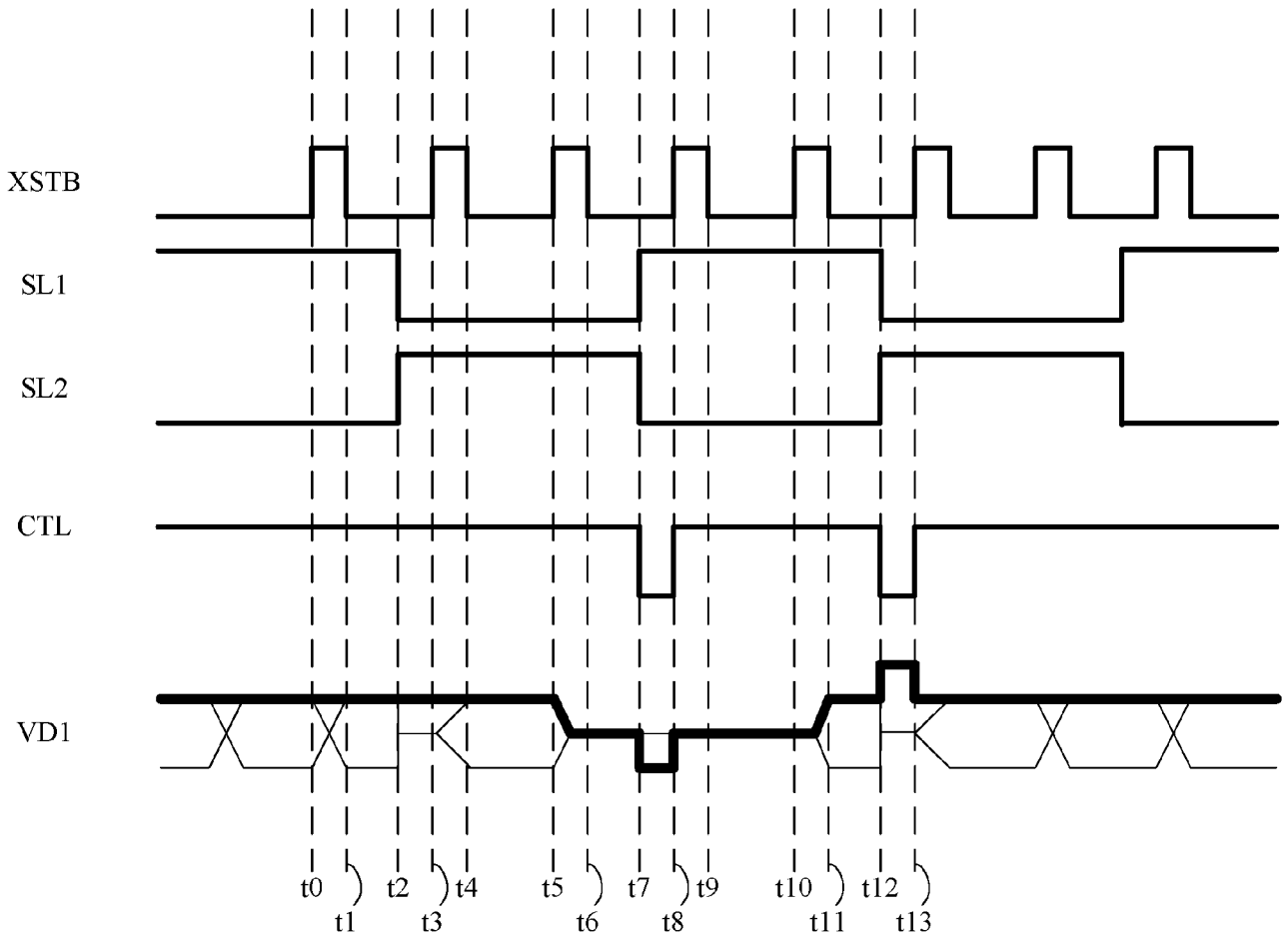
FIG. 2 is a signal diagram of signals of a display device according to an operation example of this disclosure.

Referring to FIG. 2, during the time points t1, t2, the data voltage VD1 substantially has a first data voltage level (such as a data voltage level corresponding to the grayscale value 255). At this time, the multiplexing signal SL1 has a first switching voltage level (such as a high voltage level), and the multiplexing signal SL2 has a second switching voltage level (such as a low voltage level). The data voltage VD1 is supplied to the corresponding data line (such as the data line DL1) through the output pin P1 corresponding to the multiplexing signals SL1 and SL2.

At the time point t2, the multiplexing signals SL1 and SL2 both transit such that the multiplexing signal SL1 has the second switching voltage level and the multiplexing signal SL2 has the first switching voltage level, so that the multiplexer MUX performs the switching operation. In this operation example, the time point t2 can be regarded as the end time point of the multiplexing signal SL1 and the start time point of the multiplexing signal SL2.

During the time points t2, t5, the data voltage VD1 still substantially has the first data voltage level. The data voltage VD1 is supplied to another corresponding data line (such as the data line D2) through the output pin P1 corresponding to the multiplexing signals SL1 and SL2.

During the time points t5, t6, the data voltage VD1 varies to substantially have the second data voltage level (such as the data voltage level corresponding to the grayscale value 0).

At the time point t7, the multiplexing signals SL1 and SL2 both transit such that the multiplexing signal SL1 has the first switching voltage level and the multiplexing signal SL2 has the second switching voltage level, so that the multiplexer MUX performs the switching operation. In this operation example, the time point t7 can be regarded as the start time point of the multiplexing signal SL1 and the end time point of the multiplexing signal SL2.

During the time points t7, t8, the controller 100 outputs a control signal CTL corresponding to the variation (e.g., variation amount) of the data voltage VD1 during the time points t5, t6 (i.e., the voltage difference between the first data voltage level and the second data voltage level) is substantially greater than or equal to a preset variation threshold. At this time, the source driver SD outputs a first default voltage level VF1 corresponding to the control signal CTL. In one embodiment, the first default voltage level VF1 is less than the second data voltage level.

In some display devices, since the voltage level charged by the data voltage VD1 having the first data voltage level during the time points t0, t2 still remains on the data line DL1 at the time point t7, once the multiplexer MUX performs a switching operation, the residual voltage level affects the output of the source driver SD (for example, the output voltage level is instantaneously increased or decreased), thereby causing noise in the touch sensing.

In contrast, in the embodiment of this disclosure, by making the source driver SD output the first default voltage level VF1 at the time point t7, the residual voltage level on the data line can be cleared to reduce the noise in the touch sensing.

Then, during the time points t8, t10, the data voltage VD1 still substantially has the second data voltage level. The data voltage VD1 is supplied to the corresponding data line (such as the data line DL1) corresponding to the multiplexing signals SL1 and SL2.

During the time points t10, t11, the data voltage VD1 varies to substantially have the first data voltage level.

At the time point t12, the multiplexing signals SL1 and SL2 both transit such that the multiplexing signal SL1 has the second switching voltage level and the multiplexing signal SL2 has the first switching voltage level, so that the multiplexer MUX performs the switching operation. In this operation example, the time point t2 can be regarded as the end time point of the multiplexing signal SL1 and the start time point of the multiplexing signal SL2.

During the time points t12, t13, the controller 100 outputs a control signal CTL corresponding to the variation of the data voltage VD1 during the time points t10, t11 (i.e., the voltage difference between the first data voltage level and the second data voltage level) is substantially greater than or equal to the aforementioned preset variation threshold or another preset variation threshold. At this time, the source driver SD outputs a second default voltage level VF2 corresponding to the control signal CTL. In one embodiment, the second default voltage level VF2 is greater than the first data voltage level. In one embodiment, the second default voltage level VF2 is different from the first default voltage level VF1.

Similar to the description in the foregoing paragraph, in the embodiment of this disclosure, by making the source driver SD output the second default voltage level VF2 at the time point t12, the residual voltage level on the data line can be cleared to reduce the noise in the touch sensing.

It should be noted that in this operation example, at the time point t2, since the data voltage VD1 is maintained at the first data voltage level before the time point t2, the controller 100 does not generate the control signal CTL, and the source driver SD also does not output the aforementioned first default voltage level or second default voltage level.

In one embodiment, the controller 100 records the voltage levels of the data voltage VD1, and in the case that the variation of the data voltage VD1 is substantially greater than or equal to the preset variation threshold, the controller 100 outputs the control signal CTL in immediately following transition of the multiplexing signals SL1 and SL2 (such as time points t7 and t12). In one embodiment, the aforementioned preset variation threshold may be, for example, the voltage difference between a voltage level of the data voltage VD1 corresponding to the grayscale value 255 (such as +5V) and a voltage level of the data voltage VD1 corresponding to the grayscale value 0 (such as 0V), but this disclosure is not limited thereto.

For example, after the data voltage VD1 varies from a voltage level corresponding to the grayscale value 255 to a voltage level corresponding to the grayscale value 0, or varies from a voltage level corresponding to the grayscale value 0 to a voltage level corresponding to the grayscale value 255, the controller 100 can output the control signal CTL accordingly.

In another embodiment, the controller 100 records the grayscale value corresponding to the data voltage VD1 in the aforementioned grayscale data DATA, and in the case that the variation amount of the grayscale value corresponding to the data voltage VD1 is substantially greater than or equal to the preset variation threshold, outputs the control signal CTL in immediately following transition of the multiplexing signals SL1 and SL2 transit (such as time points t7 and t12). In one embodiment, the preset variation threshold may be, for example, a grayscale variation amount 255, but is not limited thereto.

For example, after some of the grayscale data corresponding to the data voltage VD1 varies from the grayscale value 255 to the grayscale value 0, or varies from the grayscale value 0 to the grayscale value 255, the controller 100 can output the control signal CTL accordingly.

In one embodiment, at the aforementioned time points t7 and t12, the output pin P1 selectively outputs different default voltage levels corresponding to different polarities of the data voltage VD1. It should be noted that the different polarities of the data voltage VD1 used herein indicate that the source driver SD alternately outputs the data voltage VD1 which is greater or less than a common electrode voltage for for reversing the twisting angle of the liquid crystal.

For example, in the above operation example, in the case that the data voltage VD1 is in positive polarity (for example, the voltage level of the data voltage VD1 is between +5V and 0V), at the aforementioned time point t7, the source driver SD outputs a first default voltage level VF1 less than the second data voltage level through the output pin P1 corresponding to the control signal CTL to clear the residual voltage level on the data line DL1. Similarly, at the time point t12, the source driver SD outputs a second default voltage level VF2 greater than the first data voltage level through the output pin P1 and corresponding to the control signal CTL to clear the residual voltage level on the data line.

Figure 3:
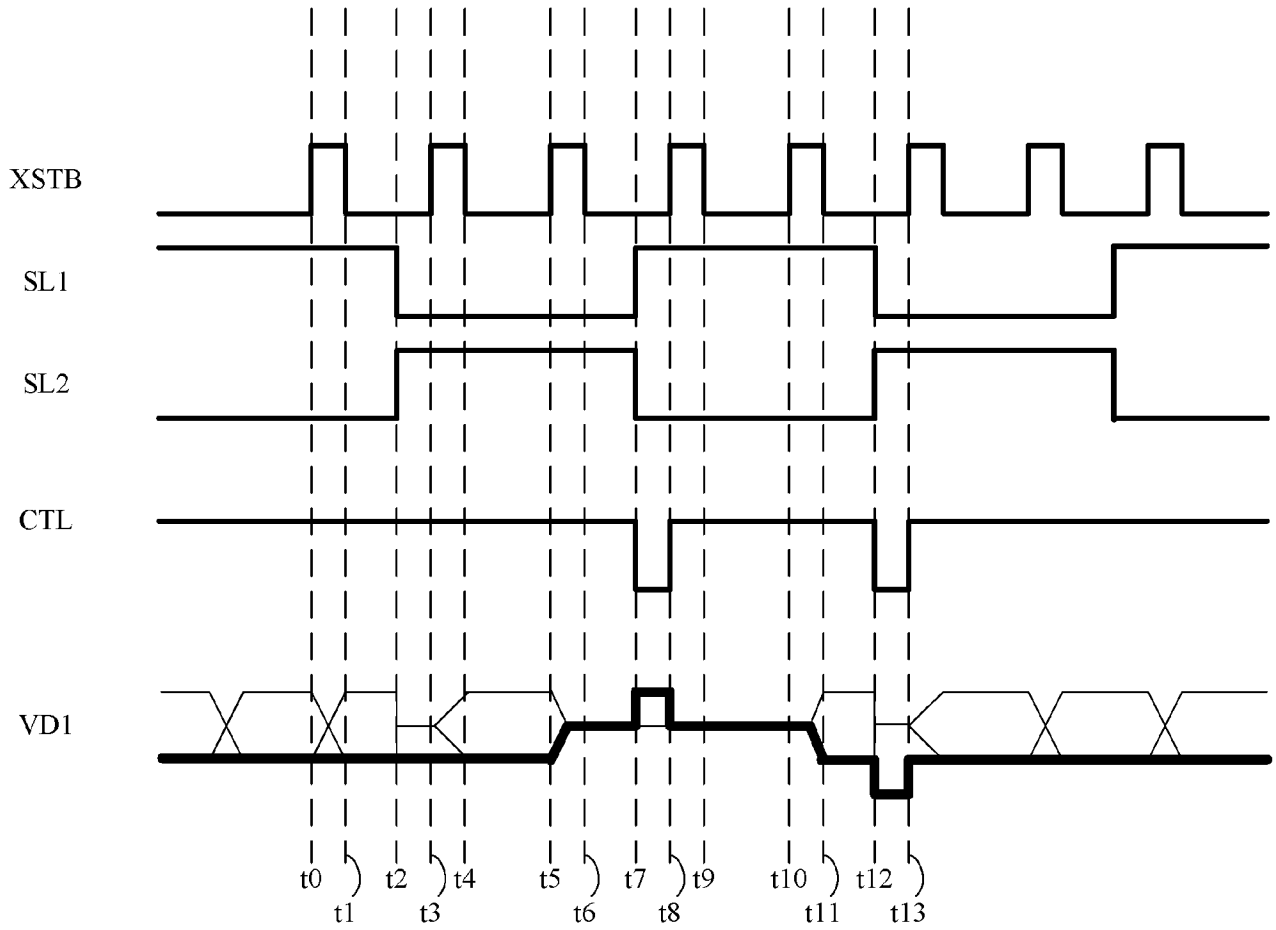
FIG. 3 is a signal diagram of signals of a display device according to another operation example of this disclosure.

Further referring to FIG. 3, in the operation example of FIG. 3, in the case that the data voltage VD1 is in negative polarity (for example, the voltage level of the data voltage VD1 is between −5V and 0V), the data voltage VD1 substantially has a third data voltage level (such as the data voltage level corresponding to the grayscale value 255) (such as −5V) during the time points t0, t5, and the data voltage VD1 varies to substantially have a fourth data voltage level (such as the data voltage level corresponding to the grayscale value 0) (such as 0V) during the time points t5, t6. During the time points t7, t8, the source driver SD outputs a third default voltage level VF3 greater than the fourth data voltage level through the output pin P1 corresponding to the control signal CTL to clear the residual voltage level on the data line. In one embodiment, the third default voltage level VF3 may be the same as the second default voltage level VF2, but this disclosure is not limited thereto.

Similarly, the data voltage VD1 varies to substantially have a third data voltage level (such as −5V) during the time points t10, t11. During the time points t12, t13, the source driver SD outputs a fourth default voltage level VF4 less than the third data voltage level through the output pin P1 corresponding to the control signal CTL to clear the residual voltage level on the data line. In one embodiment, the fourth default voltage level VF4 is different from the third default voltage level VF3. In one embodiment, the fourth default voltage level VF4 may be the same as the second default voltage level VF1, but this disclosure is not limited thereto.

By performing the operation like this, the residual voltage level on the data line can be cleared to reduce the noise in the touch sensing.

Figure 4:
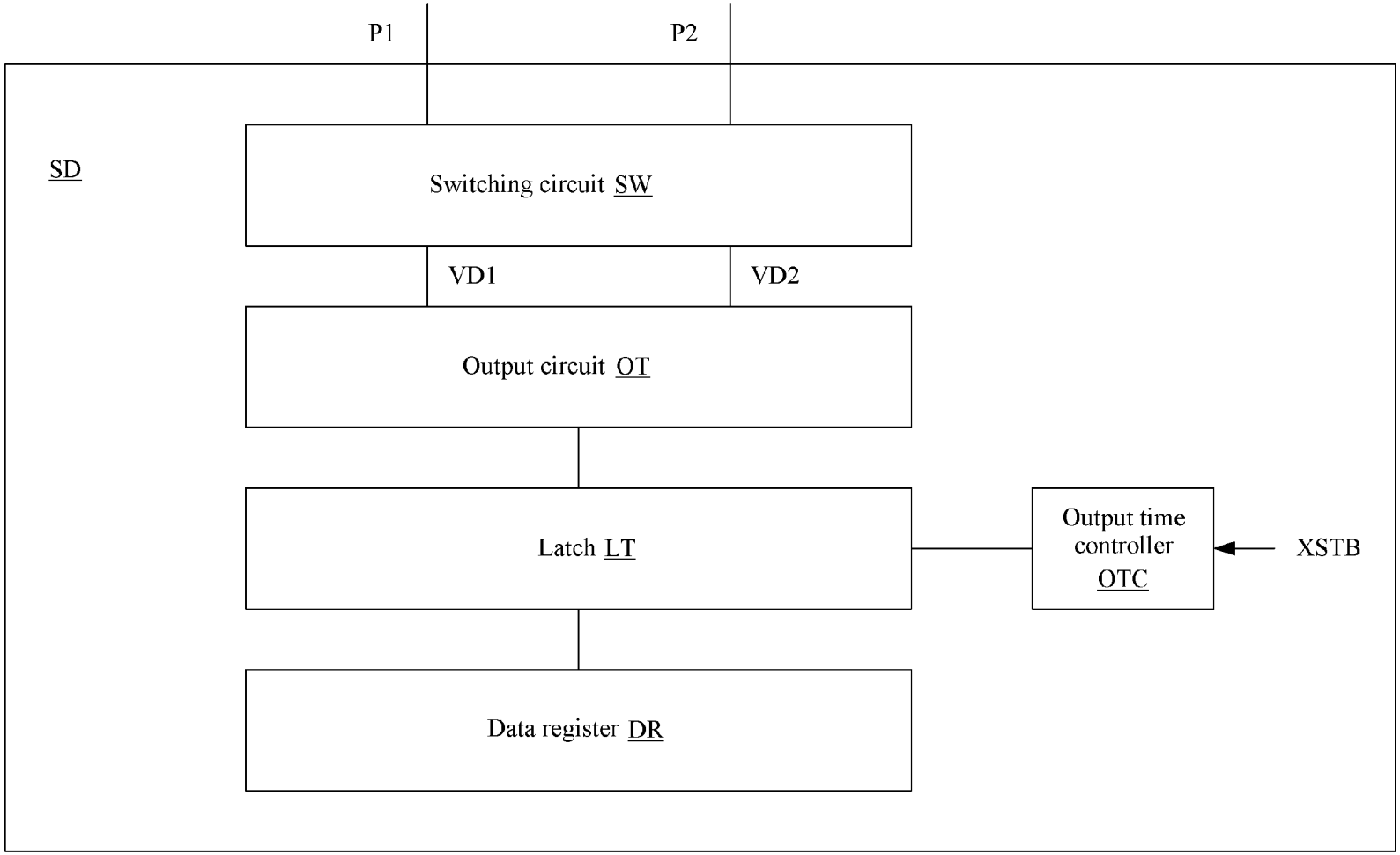
FIG. 4 is a schematic diagram of a source driver according to an embodiment of this disclosure.

FIG. 4 is a schematic diagram of a source driver SD according to an embodiment of this disclosure. In one embodiment, the source driver SD includes a data register DR, a latch LT, an output circuit OT, an output time controller OTC, and a switching circuit SW.

In one embodiment, the data register DR is configured to supply the data voltages VD1 and VD2 to the latch LT. The output time controller OTC is configured to control the latch LT to supply the data voltages VD1 and VD2 to the output circuit OT corresponding to the trigger signal XSTB. The output circuit OT supplies the data voltages VD1 and VD2 to the output pins P1 and P2 through the switching circuit SW. In some embodiments, the voltage output from the aforementioned source driver SD to the output pins P1 and P2 may be output by the output circuit OT.

In one embodiment, the switching circuit SW may be configured to selectively output the aforementioned default voltage level and the data voltages VD1 and VD2 corresponding to the control signal CTL and the data voltages VD1 and VD2.

Figure 5:
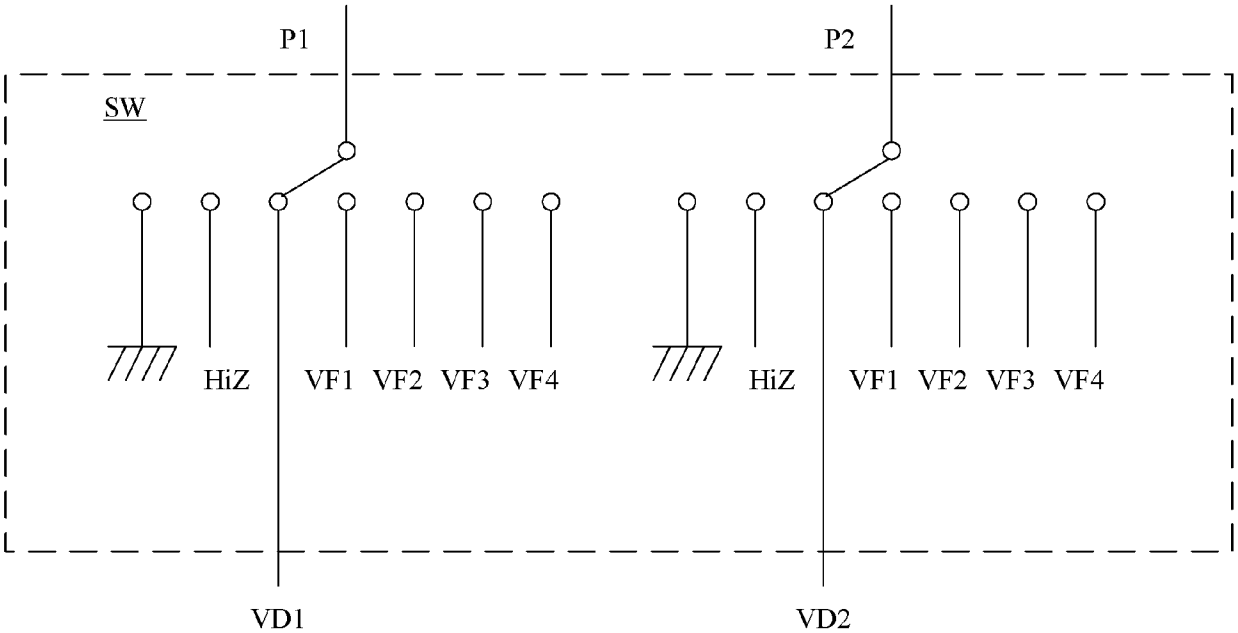
FIG. 5 is a schematic diagram of a switching circuit according to an embodiment of this disclosure.

For example, referring to FIG. 5, at the aforementioned time point t7, corresponding to the variation of the data voltage VD1 during the time points t5, t6, the switching circuit SW can perform switching corresponding to the start time point (such as a falling edge) of the control signal CTL, so that the output pin P1 varies from outputting the data voltage VD1 to outputting the first default voltage level VF1 or the third default voltage level VF3.

At the aforementioned time point t8, the switching circuit SW can perform switching corresponding to the end time point (such as a rising edge) of the control signal CTL, so that the output pin P1 varies from outputting the first default voltage level VF1 or the third default voltage level VF3 to outputting the data voltage VD1.

At the aforementioned time point t12, corresponding to the variation of the data voltage VD1 during the time points t10, t11, the switching circuit SW can perform switching corresponding to the start time point (such as the falling edge) of the control signal CTL, so that the output pin P1 varies from outputting the data voltage VD1 to outputting the second default voltage level VF2 or the fourth default voltage level VF4.

At the aforementioned time point t13, the switching circuit SW can perform switching corresponding to the end time point (such as the rising edge) of the control signal CTL, so that the output pin P1 varies from outputting the second default voltage level VF2 or the fourth default voltage level VF4 to outputting the data voltage VD1.

In the embodiment shown in FIG. 5, the switching circuit SW can also ground the output pins P1 and P2 or make the output pins P1 and P2 be in a high impedance state HiZ, but this disclosure is not limited thereto. It should be noted that in some cases, the aforementioned default voltage levels VF1-VF4 may be partially identical to each other, so the switching circuit SW may also be varied correspondingly.

In one embodiment, the first default voltage level VF1 is equal to, for example, an AVDD voltage level in negative polarity (such as −5.5V), where the AVDD voltage level in negative polarity is generated according to a reference voltage level (such as −6V) that used to generate the data voltages VD1 and VD2 in negative polarity corresponding to the grayscale values 0 to 255. In other embodiments, the first default voltage level VF1 may also be equal to the voltage level of the data voltages VD1 and VD2 corresponding to the grayscale values 255, 190, 127, 63 and 0 when the data voltages VD1 and VD2 are in negative polarity, or equal to the voltage level of the data voltages VD1 and VD2 corresponding to the grayscale values 190, 127, 63 and 0 when the data voltages VD1 and VD2 are in positive polarity, but is not limited thereto.

In one embodiment, the second default voltage level VF2 is equal to, for example, an AVDD voltage level in positive polarity (such as +5.5V), where the AVDD voltage level in positive polarity is generated according to a reference voltage level (such as +6V) used to generate the data voltages VD1 and VD2 in positive polarity corresponding to the grayscale values 0 to 255. In other embodiments, the second default voltage level VF2 may also be equal to the above reference voltage level (such as +6V), but is not limited thereto.

In one embodiment, the third default voltage level VF3 is equal to, for example, an AVDD voltage level in positive polarity (such as +5.5V). In other embodiments, the third default voltage level VF3 may also be equal to the voltage level of the data voltage VD1 corresponding to the grayscale values 255, 190, 127, 63 and 0 when the data voltages VD1 and VD2 are in positive polarity, or equal to the voltage level of the data voltages VD1 and VD2 corresponding to the grayscale values 190, 127, 63 and 0 when the data voltages VD1 and VD2 are in negative polarity, but is not limited thereto.

In one embodiment, the fourth default voltage level VF4 is equal to, for example, an AVDD voltage level in negative polarity (such as −5.5V). In other embodiments, the fourth default voltage level VF4 may also be equal to the above reference voltage level (such as −6V), but is not limited thereto.

Figure 6:
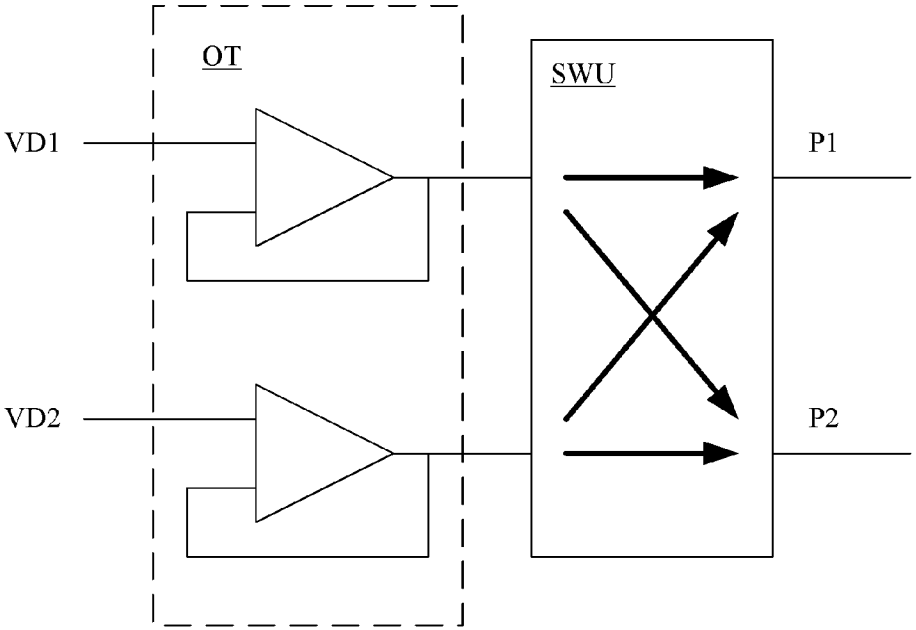
FIG. 6 is a schematic diagram of an output circuit and a switching unit according to another embodiment of this disclosure.

Further referring to FIG. 6, in one embodiment of this disclosure, the source driver SD further includes a switching unit SWU. In this embodiment, the switching unit SWU is electrically coupled between the output circuit OT and the switching unit SWU, and configured to switch the signal sources of the output pin P1 and the adjacent output pin P2 (such as the signal sources of the data voltages VD1 and VD2) to make the output pins P1 and P2 output the aforementioned default voltage level.

For example, in the case where the data voltage VD1 is in positive polarity and the data voltage VD2 is in negative polarity, in the first switching state (such as the aforementioned periods t0-t5, t6-t7, t8-t10, and t11-t12), the output pin P1 outputs a data voltage VD1 in positive polarity, and the output pin P2 outputs a data voltage VD2 in negative polarity. In the second switching state (such as the aforementioned periods t7-t8, and t12-t13), the output pin P1 outputs a data voltage VD2 in negative polarity as the aforementioned default voltage level, and the output pin P2 outputs a data voltage VD1 in positive polarity as the aforementioned default voltage level.

Thereby, the output pins P1 and P2 can easily output the data voltages VD1 and VD2 having opposite polarities and the aforementioned default voltage level.

Although in the above operation examples corresponding to FIG. 2 and FIG. 3, the residual voltage level on the data line is cleared to reduce the noise in the touch sensing. However, in other embodiments, the noise in the touch sensing may also be reduced by other means.

Figure 7:
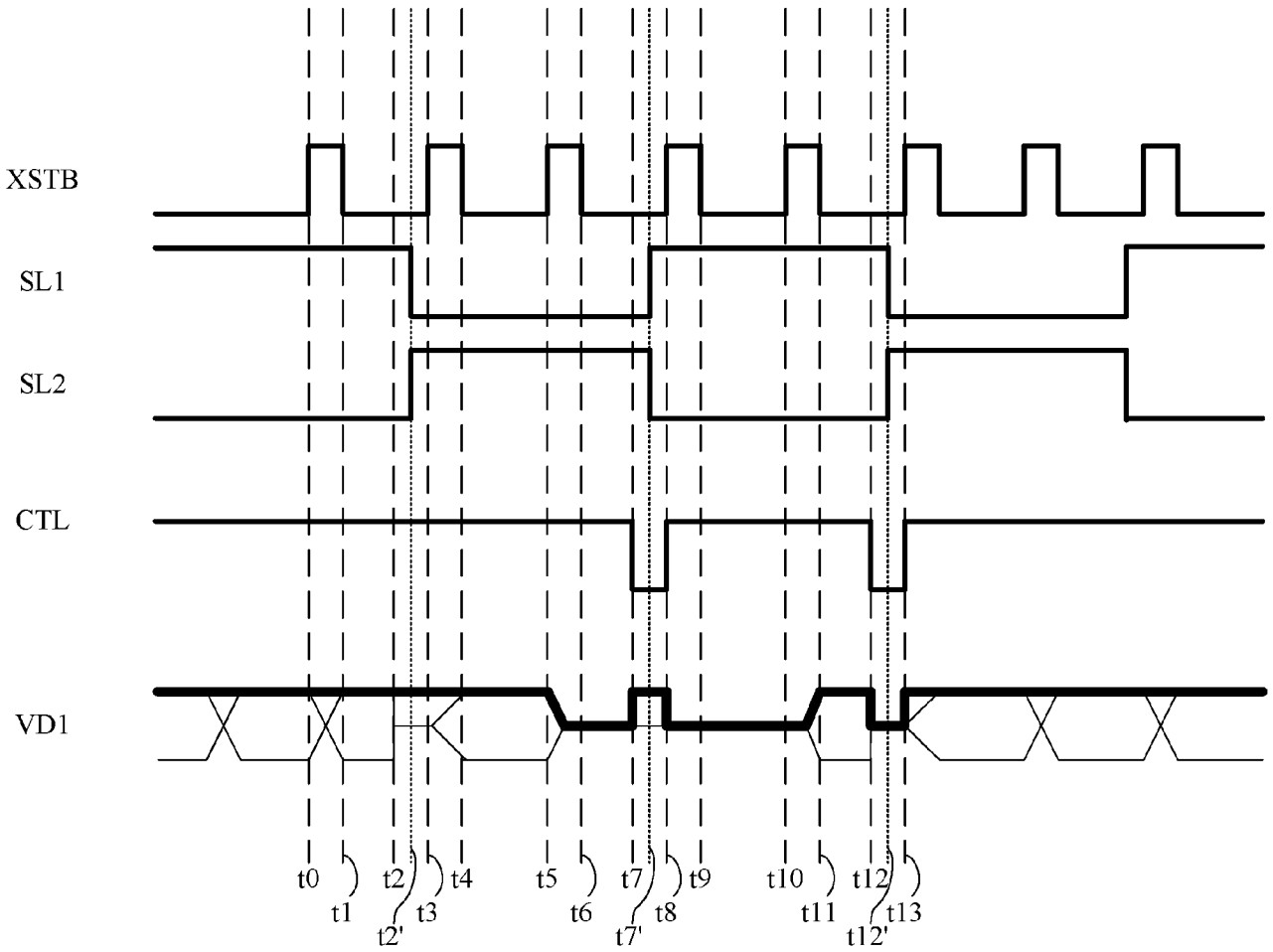
FIG. 7 is a signal diagram of signals of a display device according to another operation example of this disclosure.

Referring to FIG. 7, FIG. 7 is a signal diagram according to another operation example of this disclosure. This operation example is substantially the same as the operation example shown in FIG. 2 except that the transition time points of the multiplexing signals SL1 and SL2 are postponed to the time points t2', t7' and t9', so similar descriptions are not repeated herein.

In this operation example, except that the transition time points of the multiplexing signals SL1 and SL2 are postponed to the time point t2', the operation during the time points t0, t7 is substantially similar to the operation example shown in FIG. 2, so similar descriptions are not repeated herein.

At the time point t7, the controller 100 outputs a control signal CTL corresponding to the variation of the data voltage VD1 during the time points t5, t6 (i.e., the voltage difference between the first data voltage level and the second data voltage level) is substantially greater than or equal to a preset variation threshold. At this time, the source driver SD varies from outputting the data voltage VD1 to outputting the first default voltage level VF1' corresponding to the start time point (such as the falling edge) of the control signal CTL. In one embodiment, the first default voltage level VF1' is greater than the second data voltage level.

At the time point t7', the multiplexing signals SL1 and SL2 both transit such that the multiplexing signal SL1 has a first switching voltage level and the multiplexing signal SL2 has a second switching voltage level, so that the multiplexer MUX performs the switching operation. In this operation example, the time point t7' can be regarded as the start time point of the multiplexing signal SL1 and the end time point of the multiplexing signal SL2.

As described above, in some display devices, since the voltage level charged by the data voltage VD1 having the first data voltage level during the time points t0, t2' still remains on the data line DL1 at the time point t7', once the multiplexer MUX performs a switching operation, the residual voltage level affects the output of the source driver SD (for example, the output voltage level is instantaneously increased or decreased), thereby causing negative interference.

In contrast, in the embodiment of this disclosure, by making the multiplexing signals SL1 and SL2 transit when the data voltage VD1 has the first default voltage level VF1', the noise in the touch sensing caused by the residual voltage level on the data line can be reduced.

At the time point t8, the source driver SD varies from outputting the first default voltage level VF1' to outputting the data voltage VD1 corresponding to the end time point (such as the rising edge) of the control signal CTL.

Then, during the time points t8, t12, the operation of this operation example is substantially similar to the operation example shown in FIG. 2, and therefore will not be repeated herein.

At the time point t12, the controller 100 outputs a control signal CTL corresponding to the variation of the data voltage VD1 during the time points t10, t11 (i.e., the voltage difference between the first data voltage level and the second data voltage level) is substantially greater than or equal to a preset variation threshold. At this time, the source driver SD varies from outputting the data voltage VD1 to outputting the second default voltage level VF2' corresponding to the start time point (such as the falling edge) of the control signal CTL. In one embodiment, the second default voltage level VF2' is less than the first data voltage level. In one embodiment, the second default voltage level VF2' is different from the first default voltage level VF1'.

At the time point t12', the multiplexing signals SL1 and SL2 both transit such that the multiplexing signal SL1 has a second switching voltage level and the multiplexing signal SL2 has a first switching voltage level, so that the multiplexer MUX performs the switching operation. In this operation example, the time point t12' can be regarded as the end time point of the multiplexing signal SL1 and the start time point of the multiplexing signal SL2.

Similarly, by making the multiplexing signals SL1 and SL2 transit when the data voltage VD1 has the second default voltage level VF2', the noise in the touch sensing caused by the residual voltage level on the data line can be reduced.

In one embodiment, at the time points t7 and t12 corresponding to the operation example of FIG. 7, the output pin P1 selectively outputs different default voltage levels corresponding to different polarities of the data voltage VD1.

For example, in the case where the data voltage VD1 is in positive polarity (for example, the voltage level of the data voltage VD1 is between +5V and 0V), at the aforementioned time point t7, the source driver SD outputs a first default voltage level VF1' greater than the second data voltage level through the output pin P1 corresponding to the control signal CTL. Similarly, at the aforementioned time point t12, the source driver SD outputs a second default voltage level VF2' less than the first data voltage level through the output pin P1 corresponding to the control signal CTL.

Figure 8:
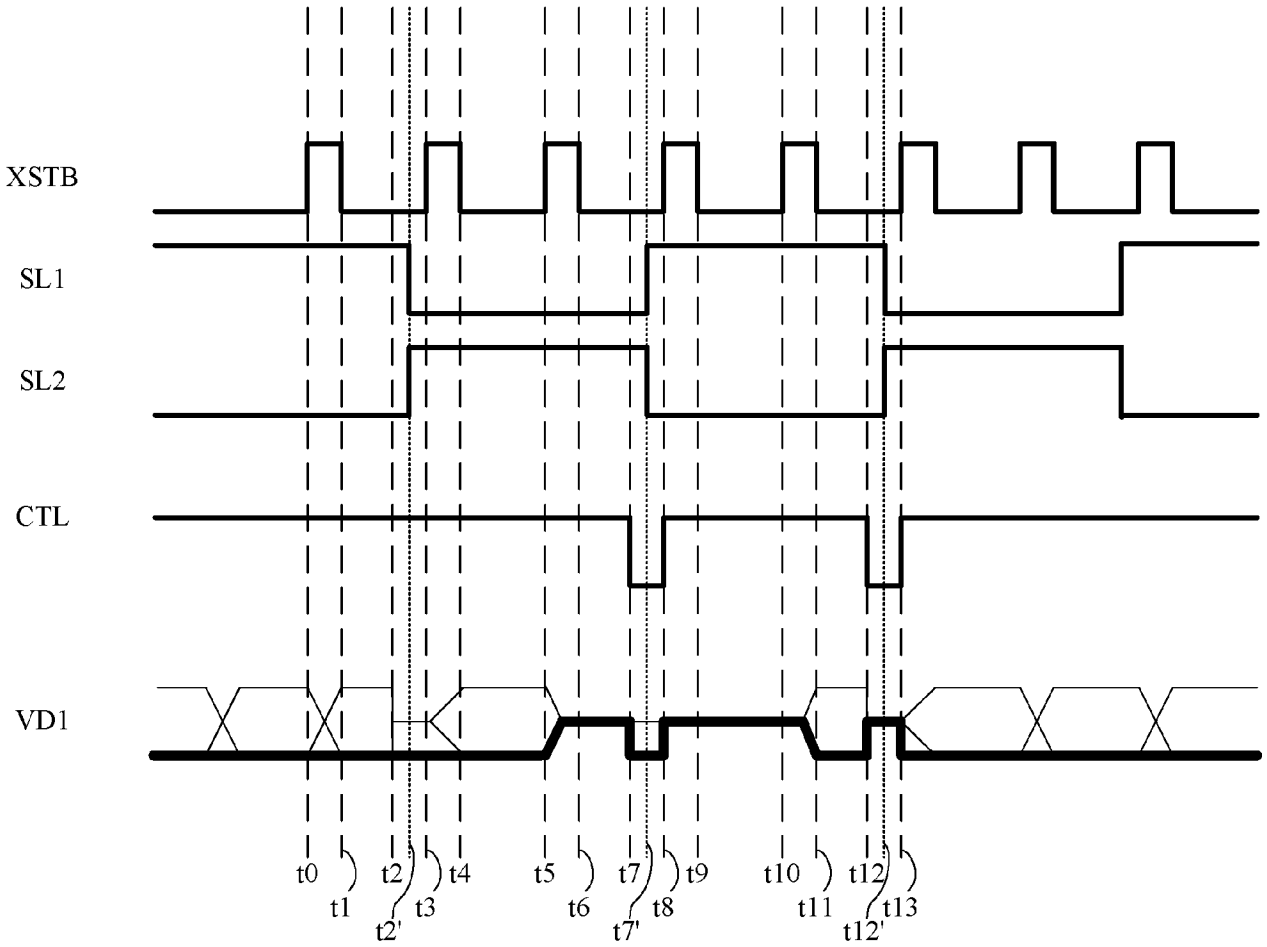
FIG. 8 is a signal diagram of signals of a display device according to another operation example of this disclosure.

Referring to FIG. 8, in the operation example corresponding to FIG. 8, the data voltage VD1 is in negative polarity (e.g., the voltage level of the data voltage VD1 is between −5V and 0V). The operation example corresponding to FIG. 7 is similar to the operation example corresponding to FIG. 3 described above, and thus will not be repeated herein. In this operation example, at the time point t7, the source driver SD outputs a third default voltage level VF3' less than the fourth data voltage level through the output pin P1 and corresponding to the control signal CTL. At the time point t12, the source driver SD outputs a fourth default voltage level VF4' greater than the third data voltage level through the output pin P1 corresponding to the control signal CTL.

In one embodiment, the second default voltage level VF2' may be the same as the fourth default voltage level VF4', but this disclosure is not limited thereto.

Through the operation described above, the noise in the touch sensing caused by the residual voltage level on the data line can be reduced.

It should be understood that the aforementioned operation examples corresponding to FIG. 7 and FIG. 8 can also be applied to the structures in FIG. 4, FIG. 5 and FIG. 6, and similar descriptions are not repeated herein.

In one embodiment, the first default voltage level VF1' is equal to, for example, an AVDD voltage level in positive polarity (such as +5.5V). In other embodiments, the first default voltage level VF1' may also be equal to the voltage level of the data voltages VD1 and VD2 corresponding to the grayscale values 255, 190, 127 and 63 when the data voltages VD1 and VD2 are in positive polarity, but not limited thereto.

In one embodiment, the second default voltage level VF2' is equal to, for example, the voltage level of the data voltages VD1 and VD2 corresponding to the grayscale values 190, 127, 63 and 0 when the data voltages VD1 and VD2 are in positive polarity, but is not limited thereto. In other embodiments, the second default voltage level VF2' may also be equal to the voltage level of the data voltages VD1 and VD2 corresponding to the grayscale values 255, 190, 127, 63 and 0 when the data voltages VD1 and VD2 are in negative polarity, or equal to an AVDD voltage level in negative polarity (such as −5.5V), but is not limited thereto.

In one embodiment, the third default voltage level VF3' is equal to, for example, an AVDD voltage level in negative polarity (such as −5.5V). In other embodiments, the third default voltage level VF3' may also be equal to the voltage level of the data voltages VD1 and VD2 corresponding to the grayscale values 255, 190, 127 and 63 when the data voltages VD1 and VD2 are in negative polarity, or equal to an AVDD voltage level in negative polarity (such as −5.5V), but is not limited thereto.

In one embodiment, the fourth default voltage level VF4' is equal to, for example, the voltage level of the data voltages VD1 and VD2 corresponding to the grayscale values 190, 127, 63 and 0 when the data voltages VD1 and VD2 are in negative polarity, but not limited thereto. In other embodiments, the fourth default voltage level VF4' may also be equal to the voltage level of the data voltages VD1 and VD2 corresponding to the grayscale values 255, 190, 127, 63 and 0 when the data voltages VD1 and VD2 are in positive polarity, or equal to an AVDD voltage level in positive polarity (such as +5.5V), but is not limited thereto.

Figure 9:
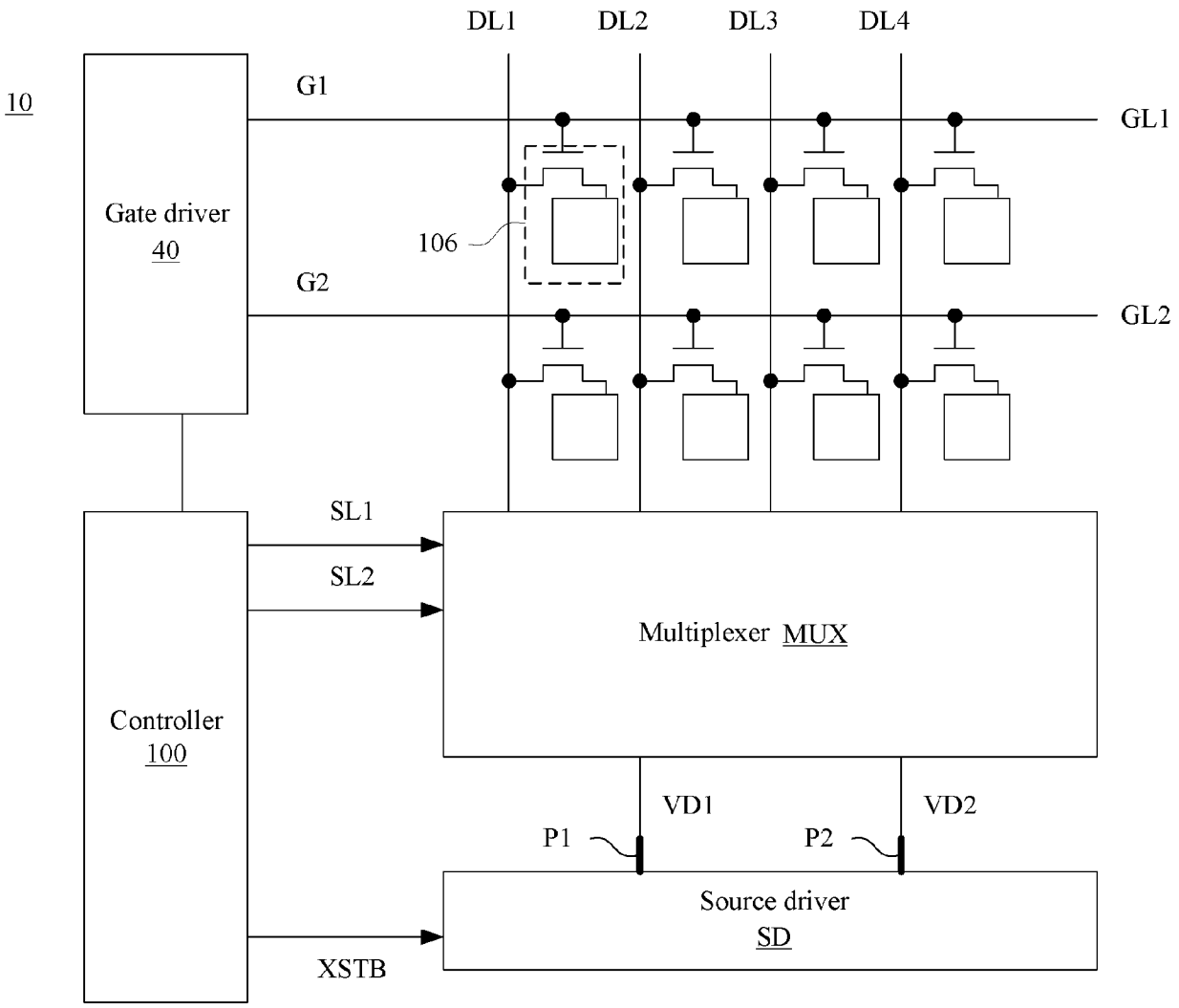
FIG. 9 is a schematic diagram of a display device according to another embodiment of this disclosure.

The details of this disclosure will be explained below through FIGS. 9-11, but this disclosure is not limited thereto. It should be noted that the display device 10 corresponding to the embodiment of FIGS. 9-11 is substantially similar to the display device 10 corresponding to the embodiment of FIGS. 1-8, and thus the same portions will not be repeated herein.

In this embodiment, the control signal CTL can be omitted, and the source driver SD can be used to output the default voltage level different from the data voltages VD1 and VD2 through the output pins P1 and P2 according to the trigger signal XSTB. In addition, in this embodiment, the transition times of the multiplexing signals SL1 and SL2 are staggered with each other (see FIG. 10 and FIG. 11).

Figure 10:
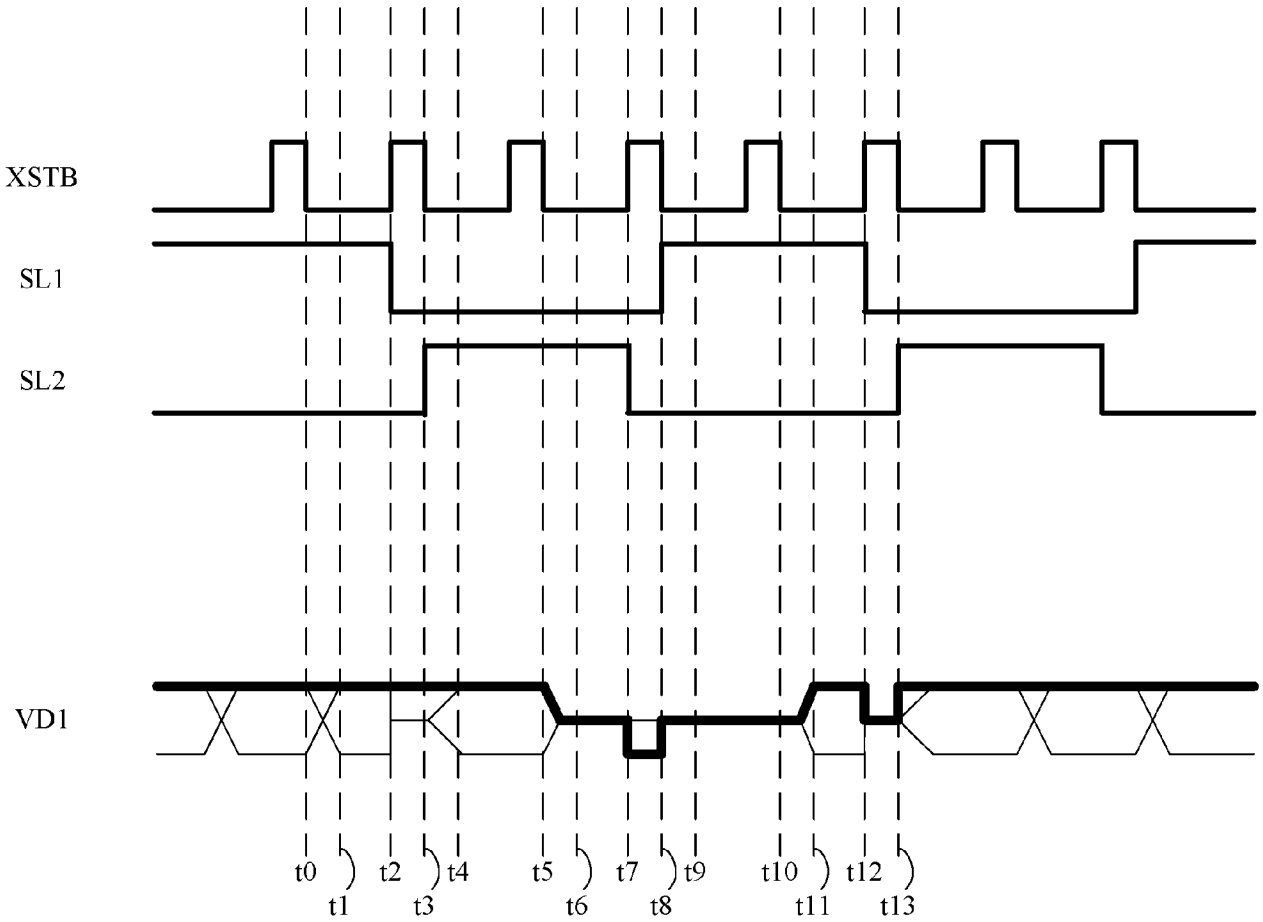
FIG. 10 is a signal diagram of signals of a display device according to another embodiment of this disclosure.

Referring to FIG. 10, in one embodiment, in the case that the data voltage VD1 is in positive polarity (for example, the voltage level of the data voltage VD1 is between +5V and 0V), the source driver SD outputs a first default voltage level VF1" less than the second data voltage level through the output pin P1 corresponding to the trigger signal XSTB to clear the residual voltage level on the data line DL1. At the aforementioned time point t12, the source driver SD outputs a second default voltage level VF2" less than the first data voltage level through the output pin P1 corresponding to the trigger signal XSTB.

Figure 11:
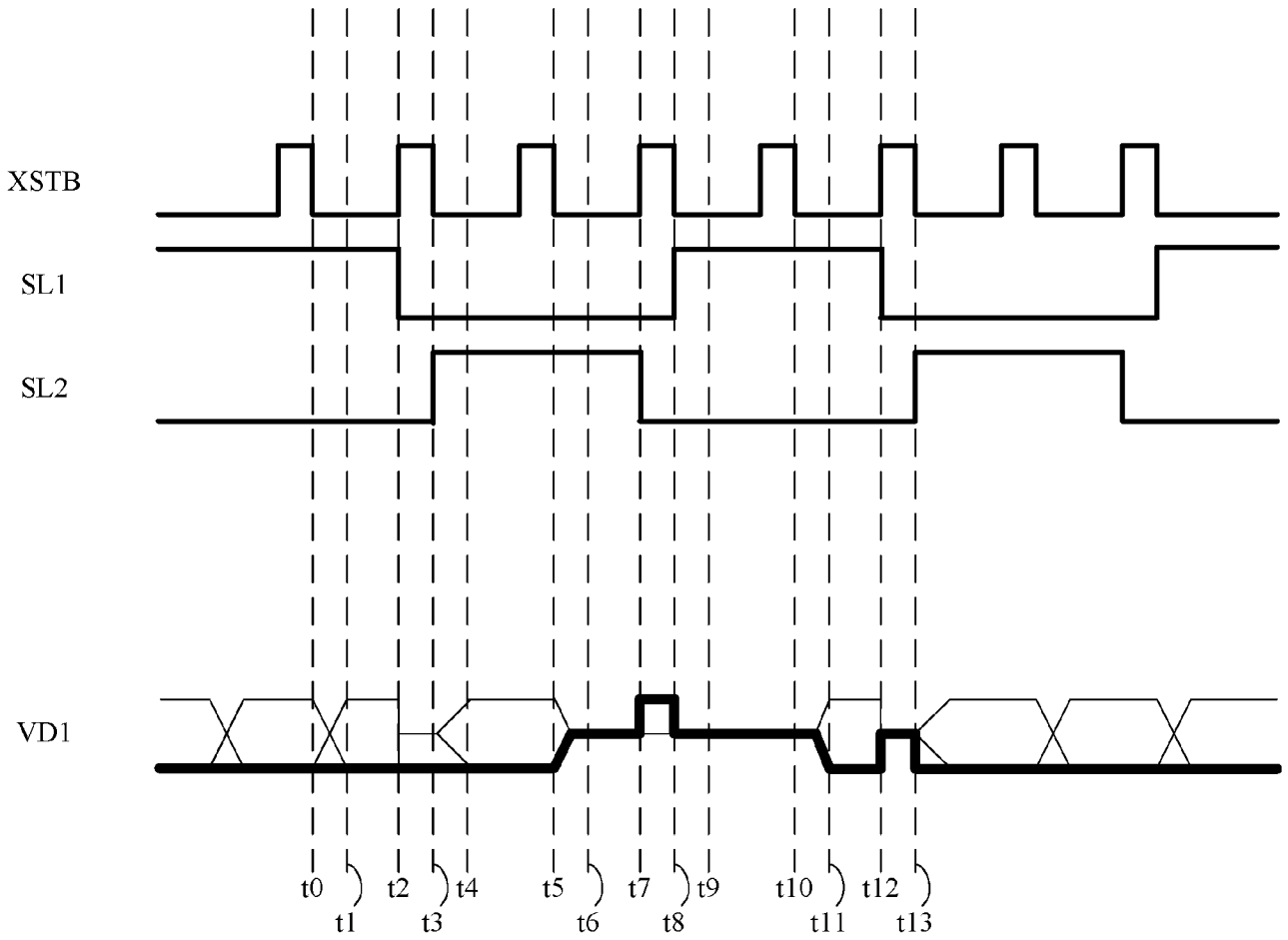
FIG. 11 is a signal diagram of signals of a display device according to another embodiment of this disclosure.

Referring to FIG. 11, in one embodiment, in the case that the data voltage VD1 is in negative polarity (for example, the voltage level of the data voltage VD1 is between −5V and 0V), the source driver SD outputs a third default voltage level VF3" greater than the fourth data voltage level through the output pin P1 corresponding to the trigger signal XSTB to clear the residual voltage level on the data line DL1. At the aforementioned time point t12, the source driver SD outputs a fourth default voltage level VF4" greater than the third data voltage level through the output pin P1 corresponding to the trigger signal XSTB.

In one embodiment, the first default voltage level VF1" is equal to, for example, an AVDD voltage level in negative polarity (such as −5.5V). In other embodiments, the first default voltage level VF1" may also be equal to the voltage level of the data voltages VD1 and VD2 corresponding to the grayscale values 255, 190, 127 and 63 when the data voltages VD1 and VD2 are in negative polarity, but is not limited thereto.

In one embodiment, the second default voltage level VF2" is equal to, for example, the voltage level of the data voltages VD1 and VD2 corresponding to the grayscale values 190, 127, 63 and 0 when the data voltages VD1 and VD2 are in positive polarity, but not limited thereto. In other embodiments, the second default voltage level VF2" may also be equal to the voltage level of the data voltages VD1 and VD2 corresponding to the grayscale values 255, 190, 127, 63 and 0 when the data voltages VD1 and VD2 are in negative polarity, or equal to an AVDD voltage level in negative polarity (such as −5.5V), but is not limited thereto.

In one embodiment, the third default voltage level VF3" is equal to, for example, an AVDD voltage level in positive polarity (such as +5.5V). In other embodiments, the third default voltage level VF3" may also be equal to the voltage level of the data voltage VD1 corresponding to the grayscale values 255, 190, 127, 63 and 0 when the data voltages VD1 and VD2 are in positive polarity, but is not limited thereto.

In one embodiment, the fourth default voltage level VF4" is equal to, for example, the voltage level of the data voltages VD1 and VD2 corresponding to the grayscale values 190, 127, 63 and 0 when the data voltages VD1 and VD2 are in negative polarity, but not limited thereto. In other embodiments, the fourth default voltage level VF4" may also be equal to the voltage level of the data voltages VD1 and VD2 corresponding to the grayscale values 255, 190, 127, 63 and 0 when the data voltages VD1 and VD2 are in positive polarity, or equal to an AVDD voltage level in positive polarity (such as +5.5V), but is not limited thereto.

Although this disclosure is disclosed above by using the embodiments, the embodiments are not intended to limit this disclosure. Those of ordinary skill in the art can make various variations and modifications without departing from the spirit and the scope of this disclosure. Therefore, the protection scope of this disclosure shall be subject to the appended claims.

What is claimed is:

1. A display device, comprising:

an output circuit, configured to output a data voltage to an output pin;

a multiplexer, configured to sequentially output the data voltage to different data lines according to a first multiplexing signal and a second multiplexing signal, and a controller, configured to generate a control signal corresponding to a variation of the data voltage to make the output pin output a default voltage level different from the data voltage;

wherein when the variation of the data voltage is that the data voltage is decreased from a first data voltage level to a second data voltage level, the output pin outputs a first default voltage level, and the first default voltage level is lower than the second data voltage level; and when the variation of the data voltage is that the data voltage is increased from the second data voltage level to the first data voltage level, the output pin outputs a second default voltage level, and the second default voltage level is higher than the first data voltage level.

2. The display device according to claim 1, wherein the output pin is configured to selectively output the different default voltage levels corresponding to the polarity of the data voltage.

3. The display device according to claim 1, wherein a start time point of the first multiplexing signal is substantially the same as a time point at which the output pin starts to output the default voltage level.

4. The display device according to claim 1, wherein the controller generates the control signal when the variation of the data voltage is substantially greater than or equal to a preset variation threshold.

5. The display device according to claim 1, further comprising:

a switching circuit, configured to selectively make the output pin output one of a first default voltage level, a second default voltage level and the data voltage.

6. The display device according to claim 1, wherein the switching circuit makes the output pin output one of a first default voltage level, a second default voltage level and the data voltage corresponding to the control signal and the data voltage.

7. The display device according to claim 1, further comprising:

a switching unit, configured to switch signal sources of the output pin and an adjacent pin of the output pin to make the output pin output the default voltage level.

8. A display device, comprising:

an output circuit, configured to output a data voltage to an output pin;

a multiplexer, configured to sequentially output the data voltage to different data lines according to a first multiplexing signal and a second multiplexing signal, and a controller, configured to generate a control signal corresponding to a variation of the data voltage to make the output pin output a default voltage level different from the data voltage;

wherein when the variation of the data voltage is that the data voltage is decreased from a first data voltage level to a second data voltage level, the output pin outputs a third default voltage level, and the third default voltage level is higher than the second data voltage level; and when the variation of the data voltage is that the data voltage is increased from the second data voltage level to the first data voltage level, the output pin outputs a fourth default voltage level, and the fourth default voltage level is lower than the first data voltage level.

9. The display device according to claim 8, wherein a start time point of the first multiplexing signal and an end time point of the second multiplexing signal are in a period in which the output pin outputs the default voltage level.

10. A display device, comprising:

an output circuit, configured to output a data voltage to an output pin;

a multiplexer, configured to sequentially output the data voltage to different data lines according to at least one multiplexing signal;

a controller, configured to generate a control signal corresponding to a variation of the data voltage; and a switching circuit, electrically connected between the output pin and the multiplexer, and configured to selectively make the output pin output one of a default voltage level and the data voltage corresponding to the control signal and the data voltage, wherein the default voltage level is different from the data voltage;

wherein when the variation of the data voltage is that the data voltage is decreased from a first data voltage level to a second data voltage level, the switching circuit makes the output pin output a first default voltage level, and the first default voltage level is lower than the second data voltage level; and when the variation of the data voltage is that the data voltage is increased from the second data voltage level to the first data voltage level, the switching circuit makes the output pin output a second default voltage level, and the second default voltage level is higher than the first data voltage level.

11. The display device according to claim 10, wherein the switching circuit is configured to selectively output the different default voltage levels corresponding to the polarity of the data voltage.

12. The display device according to claim 10, wherein a switching time point of the multiplexer is substantially the same as a time point at which the output pin starts to output the default voltage level.

13. The display device according to claim 10, wherein the controller generates the control signal corresponding to the variation of the data voltage is substantially greater than or equal to a preset variation threshold.

14. The display device according to claim 10, wherein the switching circuit makes the output pin output one of a first default voltage level, a second default voltage level and the data voltage corresponding to the control signal and the data voltage.

15. The display device according to claim 10, wherein the switching circuit comprises:

a switching unit, configured to switch signal sources of the output pin and an adjacent pin of the output pin to make the output pin output the default voltage level.

16. A display device, comprising:

an output circuit, configured to output a data voltage to an output pin;

a multiplexer, configured to sequentially output the data voltage to different data lines according to at least one multiplexing signal;

a controller, configured to generate a control signal corresponding to a variation of the data voltage; and a switching circuit, electrically connected between the output pin and the multiplexer, and configured to selectively make the output pin output one of a default voltage level and the data voltage corresponding to the control signal and the data voltage, wherein the default voltage level is different from the data voltage;

wherein when the variation of the data voltage is that the data voltage is decreased from a first data voltage level to a second data voltage level, the switching circuit makes the output pin output a third default voltage level, and the third default voltage level is higher than the second data voltage level; and when the variation of the data voltage is that the data voltage is increased from the second data voltage level to the first data voltage level, the switching circuit makes the output pin output a fourth default voltage level, and the fourth default voltage level is lower than the first data voltage level.

17. The display device according to claim 16, wherein a switching time point of the multiplexer is in a period in which the output pin outputs the default voltage level.

18. A driving circuit of a display device, comprising:

an output circuit, configured to output a data voltage to an output pin;

a multiplexer, configured to perform a switching operation to sequentially output the data voltage to different data lines; and a switching circuit, electrically connected between the output pin and the multiplexer, and configured to selectively make the output pin output one of a default voltage level and the data voltage corresponding to the switching operation of the multiplexer and the variation of the data voltage, wherein the default voltage level is different from the data voltage;

wherein when the variation of the data voltage is that the data voltage is decreased from a first data voltage level to a second data voltage level, the output pin outputs a first default voltage level, and the first default voltage level is lower than the second data voltage level; and when the variation of the data voltage is that the data voltage is increased from the second data voltage level to the first data voltage level, the output pin outputs a second default voltage level, and the second default voltage level is higher than the first data voltage level.

* * * * *